US006416599B1

(12) United States Patent
Yoshikawa et al.

(10) Patent No.: US 6,416,599 B1
(45) **Date of Patent: *Jul. 9, 2002**

(54) GAS-GENERATING AGENT FOR AIR BAG

(75) Inventors: Eiichiro Yoshikawa; Ryo Minoguchi; Akihiko Kuroiwa; Takeshi Kanda, all of Himeji; Kenjiro Ikeda; Makoto Iwasaki, both of Asa-gun; Akihiko Tanaka, Himeji; Eishi Sato, Himeji; Dairi Kubo, Himeji; Kaoru Masuda; Moriyoshi Kanamaru, both of Kobe, all of (JP)

(73) Assignees: Nippon Kayaku Kabushiki-Kaisha, Tokyo; Kabushiki Kaisha Kobe Seiko Sho, Kobe, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/331,839

(22) PCT Filed: Dec. 22, 1997

(86) PCT No.: PCT/JP97/04776

§ 371 (c)(1),
(2), (4) Date: Jun. 28, 1999

(87) PCT Pub. No.: WO98/29361

PCT Pub. Date: Jul. 9, 1998

(30) Foreign Application Priority Data

Dec. 28, 1996 (JP) ..... 8-359158

(51) Int. Cl.[7] ..... C06B 31/00; C06B 31/28; C06B 31/02

(52) U.S. Cl. ..... 149/45; 149/46; 149/61

(58) Field of Search ..... 149/35, 61, 45, 149/46

(56) References Cited

U.S. PATENT DOCUMENTS 4,834,817 A * 5/1989 Zeuner et al. ..... 149/35
4,857,364 A * 8/1989 Von Bonin ..... 427/255

(List continued on next page.)

FOREIGN PATENT DOCUMENTS

| | | |
|---|---|---|
| EP | 0 864 553 | 9/1998 |
| GB | 2 022 712 | 10/1979 |
| WO | WO 95/18780 | 7/1995 |
| WO | WO 97/05087 | 2/1997 |

OTHER PUBLICATIONS

Derwent Publications, AN 1993–049482 & JP 2792548, Jun. 19, 1998.

*Primary Examiner*—Michael J. Carone
*Assistant Examiner*—Aileen J. Baker
(74) *Attorney, Agent, or Firm*—Oblon, Spivak, McClelland, Maier & Neustadt, P.C.

(57) ABSTRACT

The present invention provides a gas generating agent for an air bag including a fuel component of nitrogenous organic compound and an oxidizing agent as its major components, to which at least one metal nitride or metal carbide that is allowed to react with a metallic component contained in the fuel component or the oxidizing agent to form slag is added, thus providing the effects of: solving the slag collecting problem which stands in the way of commercially practicing the nitrogenous organic compound base fuels; promoting the size reduction of the gas generator through the full use of high rate of gasification of the nitrogenous organic compound base fuels; and providing a gas generating agent molded member which is strong and stable with age by improving heat resistant properties and formability of the nitrogenous organic compound base fuels which are poor compared with the metallic compound azide of an inorganic matter.

22 Claims, 2 Drawing Sheets

U.S. PATENT DOCUMENTS 4,865,667 A * 9/1989 Zeuner et al. ..... 149/22
4,963,203 A 10/1990 Halcomb et al. ..... 149/87
5,064,483 A * 11/1991 Zeuner ..... 149/35
5,401,340 A * 3/1995 Doll et al. ..... 149/22
5,429,691 A * 7/1995 Hinshaw et al. ..... 149/45
5,439,537 A * 8/1995 Hinshaw et al. ..... 149/22
5,500,059 A * 3/1996 Lund et al. ..... 149/19.1
5,501,823 A * 3/1996 Lund et al. ..... 264/3.1
5,551,725 A 9/1996 Ludwig ..... 280/737
5,557,062 A 9/1996 MaClaren et al. ..... 149/46
5,756,929 A * 5/1998 Lundstrom et al. ..... 149/22
5,936,195 A * 8/1999 Wheatley ..... 149/19.1
5,962,808 A * 10/1999 Lundstrom ..... 149/19.1
6,033,500 A * 3/2000 Ito et al. ..... 149/36

* cited by examiner

Fig. 3

A listing of the 60 liter tank test results

| | Nitride Carbide | Other additives | t2 (ms) | P1 (kPa) | Amounts of slag exhausted (g) | CO (ppm) | NOx (ppm) | $NO_2$ (ppm) | NO (ppm) |
|---|---|---|---|---|---|---|---|---|---|
| Ex. 1 | Silicon nitride | ... | 46.5 | 280.0 | 4.5 | 3000 | 300 | 100 | 120 |
| Ex. 2 | Silicon carbide | ... | 48.0 | 290.0 | 4.6 | 3500 | 300 | 100 | 120 |
| Ex. 3 | Silicon nitride | Synthetic HTS | 46.0 | 285.0 | 4.0 | 2500 | 250 | 70 | 70 |
| Ex. 4 | Silicon carbide | Synthetic HTS | 47.5 | 295.0 | 4.1 | 2500 | 200 | 70 | 70 |
| Ex. 5 | Silicon nitride | Aluminum nitride | 47.0 | 285.0 | 4.2 | 3000 | 250 | 70 | 70 |
| Ex. 6 | Silicon carbide | Aluminum nitride | 47.5 | 280.0 | 4.3 | 3000 | 250 | 70 | 70 |
| Ex. 7 | Silicon nitride | Aluminum oxide | 48.0 | 280.0 | 4.4 | 2000 | 200 | 50 | 50 |
| Ex. 8 | Silicon carbide | Aluminum oxide | 49.0 | 288.0 | 4.5 | 2000 | 250 | 70 | 70 |
| Compa ra. Ex. 1 | ... | Silicon dioxide | 51.0 | 277.0 | 11.5 | 8000 | 800 | 200 | 250 |
| Compa ra. Ex. 2 | ... | Silicon dioxide Synthetic HTS | 52.5 | 270.0 | 12.0 | 8000 | 700 | 350 | 300 |
| Compa ra. Ex. 3 | ... | Silicon dioxide Synthetic HTS | 67.0 | 262.0 | 9.8 | 8000 | 700 | 350 | 300 |

GAS-GENERATING AGENT FOR AIR BAG

TECHNICAL FIELD

The present invention relates to a gas generating agent for air bags, and particularly, to a novel gas generating agent having excellent capabilities of collecting slag and generating reduced harmful gas.

BACKGROUND ART

An airbag system, which is a rider protecting system, has been widely adopted in recent years for improving safety of the riders in an automobile. The airbag system operates on the principle that a gas generator is operated under control of signals from a sensor detecting a collision, to inflate an airbag between riders and an car body. The gas generator is required to have a function to produce a required and sufficient amount of clean gas containing no harmful gas in a short time.

On the other hand, the gas generating agents are press-formed into a pellet form for stability to the burning, and the pellets and equivalent are required to maintain their initial flammability characteristics over a long time even under various harsh environments. In the event that the pellets deform or decrease in strength due to deterioration with age, change of environments and the like, the flammability of the explosive compositions will exhibit at an abnormally earlier time than the initial flammability, so there is a fear that the airbag or the gas generator itself may be broken with the abnormal combustion in case of a collision, to fail in accomplishing the aim of protecting the riders or oven cause them injury. To satisfy those required functions, gas generating agents containing metallic compound azide, such as sodium azide and potassium azide, as their major component have been used hitherto. These known gas generating agents are widely used in terms of their advantages that they are burnt momentarily; that the component of combustion gas is substantially nitrogen gas only, so that no harmful gas such as CO (carbon monoxide) or NOx (nitrogen oxide) is produced; and that since the burning velocity is little influenced by the environment or the structure of the gas generator, it is easy to design the gas generator. However, the azide produced by contact of the metallic compound azide and the heavy metal has the nature of being easily exploded by impact and friction, so that it must be handled with the greatest possible caution. Further, the metallic compound azide itself is a harmful material and further has a notable disadvantage that it can decompose in the presence of water and acid to produce harmful gas.

Accordingly, as the substitution of metallic compound azide, gas generating agents containing tetrazoles, azodicarbonamides and other nitrogenous organic compounds as fuel components have been proposed by, for example, Japanese Laid-open Patent Publications No. Hei 2(1990)-225159, No. Hei 2(1990)-225389, No. Hei 3(1991)-20888, No. Hei 5(1993)-213687, No. Hei 6(1994)-80492, No. Hei 6(1994)-239684 and No. Hei 6(1994)-298587. The tetrazoles in particular have a high proportion of atoms of nitrogen in their molecular structure and inherently have the function to suppress the production of CO such that production of CO can be suppressed, so that almost no CO is produced in the combustion gas, as in the case of the metallic compound azide. Besides, the tetrazoles are superior to the abovesaid metallic compound azide in far less danger and toxicity.

Chlorates, such as alkaline metals or alkaline earth metals, perchlorates or nitrates are generally used for oxidizing agents using the nitrogenous organic compounds as fuel to be burnt. The alkaline metals or the alkaline earth metals produce oxides as a result of the burning reaction, and the oxides are harmful materials for a human body and environment such that they must be in the form of easily collectable slag to be collected in the gas generator so that they can be prevented from being released into the air bag. However, since many of the gas generating agents using the nitrogenous organic compounds as fuel to be burnt have the heat of combustion as high as 2,000–2,500 joule/g or more, the gas generated becomes high in temperature and pressure. As a result of this, the slag which is a by-product obtained in the burning of the gas generating agents increase in temperature and thus increase in flowability. In a conventional type of gas generator, a filter fitted therein tends to reduce its slag collection efficiency. For increase of the slag collection efficiency, a method of increased number of filtering members being set in the filter to cool and solidify the slag may be practical, but such a method has a disadvantage of increasing the size of the gas generator, going against the trend toward the size reduction and weight reduction of the gas generator.

Also, various methods of addition of slag forming agents have been proposed for collecting the oxide of alkaline metal or alkaline earth metal in the form of the slag to be easily collected in the filtering part with efficiency. In these methods, silicon dioxide or aluminum oxide is in principle added as an acid substance or a neutral substance easily slag-reactable with the oxides which are basic substances. The proposed methods are conceptually the same as the conventional slag-forming method for the gas generating agent using metallic compound azide as the fuel. The proposed method is the method in which silicate or aluminate is used as the oxide and is converted into a high-viscosity or high-melting, glassy substance, to collect the oxide as the slag. Japanese Laid-open Patent Publication No. Hei 4(1992)-265292, in particular, discloses the method in which a low-temperature slag-forming substance as typified by silicon dioxide and a high-temperature slag-forming forming agent (e.g. alkaline earth metal or transition-metallic oxide) which produces a solid having a melting point close to or more than the reaction temperature are both added to allow high-melting particles, which are solid matters produced by burning reaction, to react with low-temperature slag-forming agents in molten condition and the resultant particles are fused among themselves to improve the collecting efficiency.

However, the addition of the large amounts of substances that do not contribute to the generation of gas causes reduction of a relative proportion of the fuel components of the gas generating components, so that a rate of gasification is high, as compared with the known metallic compound azide, so that the advantage of the nitrogenous organic compound base fuels of holding promise of reducing the size of the gas generator may be impaired.

It is the primary object of the invention to solve the slag collecting problem which stands in the way of commercially practicing the nitrogenous organic compound base fuels. It is the secondary object of the invention to promote the size reduction of the gas generator through the full use of high rate of gasification of the nitrogenous organic compound base fuels. Further, it is the tertiary object of the invention to provide a gas generating agent molded member which is strong and stable with age by improving heat resistant properties and formability of the nitrogenous organic compound base fuels which are poor compared with the metallic compound azide of an inorganic matter.

DISCLOSURE OF THE INVENTION

The present invention provides means to solve these problems. A basic construction of the present invention comprises a fuel component of nitrogenous organic compound and an oxidizing agent as its major components, to which at least one metal nitride or metal carbide is added as a slag forming agent. The metal nitride and the metal carbide are allowed to react with a metallic component or an oxide thereof contained in the fuel component or the oxidizing agent, to form slag.

Another basic construction of the gas generating agent comprises a fuel component of nitrogenous organic compound and an oxidizing agent as its major components, to which at least one metal nitride or metal carbide and a slag forming metallic component that is allowed to react with a metallic component of the metal nitride or the metal carbide or an oxide thereof, to form high-viscosity slag are added in the form of an element (a simple substance) or a compound.

Preferable as the metal nitride used in the present invention is at least one metal nitride selected from the group consisting of silicon nitride, boron nitride, aluminum nitride, magnesium nitride, molybdenum nitride, tungsten nitride, calcium nitride, barium nitride, strontium nitride, zinc nitride, sodium nitride, copper nitride, titanium nitride, manganese nitride, vanadium nitride, nickel nitride, cobalt nitride, iron nitride, zirconium nitride, chromium nitride, tantalum nitride, niobium nitride, cerium nitride, scandium nitride, yttrium nitride and germanium nitride.

Also, preferable as the metal carbide is at least one metal carbide selected from the group consisting of silicon carbide, boron carbide, aluminum carbide, magnesium carbide, molybdenum carbide, tungsten carbide, calcium carbide, barium carbide, strontium carbide, zinc carbide, sodium carbide, copper carbide, titanium carbide, manganese carbide, vanadium carbide, nickel carbide, cobalt carbide, iron carbide, zirconium carbide, chromium carbide, tantalum carbide, niobium carbide, cerium carbide, scandium carbide, yttrium carbide and germanium carbide.

Further, the metal nitride or the metal carbide may be pulverized into impalpable powder, adding thereto the fuel component and the oxidizing agent when pulverized, so that they can be allowed to have the function as a consolidation preventing agent therefor. A common consolidation preventing agent may be included as a consolidation preventing agent.

The slag forming metallic component that can be allowed to react with the metal nitride or the metal carbide in a combustion process to form the high-viscosity slag may be contained in the fuel component or the oxidizing agent or may alternatively be added in the form of an element (a simple substance) or another compound.

The slag forming metallic component includes at least one selected from the group consisting of silicon, boron, aluminum, alkaline metals, alkaline earth metals, transition metals and rare earth metals.

It is also a preferable form that the slag forming metallic component is added in the form of hydrotalcites for which the general chemical formula is as follows:

$$(M^{2+}_{1-x}M^{3+}_{x}(OH)_2)^{x+}(A^{n-}_{x/n}.mH_2O)^{x-}$$

where $M^{2+}$ represents bivalent metal including $Mg^{2+}$, $Mn^{2+}$, $Fe^{2+}$, $Co^{2+}$, $Ni^{2+}$, $Cu^{2+}$ and $Zn^{2+}$;

$M^{3+}$ represents trivalent metal including $Al^{3+}$, $Fe^{3+}$, $Cr^{3+}$, $Co^{3+}$ and $In^{3+}$;

$A^{n-}$ represents an n-valence anion including $OH^-$, $F^-$, $Cl^-$, $NO_3^-$, $CO_3^{2-}$, $SO_4^{2-}$, $Fe(CN)_6^{3-}$, $CH_3COO^-$, oxalate ion and salicylate ion; and $0<x\leqq 0.33$.

Preferable as the hydrotalcites is synthetic hydrotalcite for which the chemical formula is $Mg_6Al_2(OH)_{16}CO_3.4H_2O$ or pyroaurite for which the chemical formula is $Mg_6Fe_2(OH)_{16}CO_3.4H_2O$.

The nitrogenous organic compound includes at least one nitrogenous organic compound selected from the group consisting of tetrazole, aminotetrazole, bitetrazole, azobitetrazole, nitrotetrazole, nitroaminotetrazole, triazole, nitroguanidine, aminoguanidine, triaminoguanidine nitrate, dicyanamido, dicyandiamido, carbohydrazide, hydrazocarbonamido, azodicarbonamide, oxamide and ammonium oxalate or their salts of alkaline metals, alkaline earth metals or transition metals. Of these nitrogenous organic compounds, tetrazole, aminotetrazole, bitetrazole, azobitetrazole, nitrotetrazole, nitroaminotetrazole, triazole are of preferable.

The oxidizing agent includes at least one oxidizing agent selected from the group consisting of nitrates of alkaline metal or alkaline earth metal, chlorates of alkaline metal or alkaline earth metal, perchlorates of alkaline metal or alkaline earth metal and ammonium nitrates.

It is also preferable that at least one water-soluble polymer compound selected from the group consisting of polyvinyl alcohol, polypropylene glycol, polyvinyl ether, polymaleic copolymers, polyethylene imide, polyvinyl pyrrolidone, polyacrylamide, sodium polyacrylate and ammonium polyacrylate is added to the gas generating agent composition as a formability modifying agent.

It is also preferable that at least one lubricant selected from the group consisting of stearic acid, zinc stearate, magnesium stearate, calcium stearate, aluminum stearate, molybdenum disulfide and graphite is added to the gas generating agent composition.

The following can be cited as preferable examples of the gas generating agent composition.

① A gas generating agent composition comprising 20 to 50 weight % 5-aminotetrazole; 30 to 70 weight % strontium nitrate; and 0.5 to 20 weight % silicon nitride.

② A gas generating agent composition comprising 20 to 50 weight % 5-aminotetrazole; 30 to 70 weight % strontium nitrate; 0.5 to 20 weight % silicon nitride; and 2 to 10 weight % synthetic hydrotalcite.

③ A gas generating agent composition comprising 20 to 50 weight % 5-aminotetrazole; 30 to 70 weight % strontium nitrate; and 0.5 to 20 weight % silicon carbide.

④ A gas generating agent composition comprising 20 to 50 weight % 5-aminotetrazole; 30 to 70 weight % strontium nitrate; 0.5 to 20 weight % silicon carbide; and 2 to 10 weight % synthetic hydrotalcite.

⑤ A gas generating agent composition comprising 20 to 50 weight % 5-aminotetrazole; 30 to 70 weight % strontium nitrate; and 0.5 to 20 weight % silicon nitride, wherein a slag forming metallic compound comprising at least one slag forming metal selected from the group consisting of aluminum, magnesium, yttrium, calcium, cerium and scandium is further mixed in the range of 1:9 to 9:1 in a ratio of the silicon nitride to the slag forming metallic compound.

⑥ A gas generating agent composition comprising 20 to 50 weight % 5-aminotetrazole; 30 to 70 weight % strontium nitrate; and 0.5 to 20 weight % silicon carbide, wherein a slag forming metallic compound comprising at least one slag forming metal selected from the group consisting of aluminum, magnesium, yttrium, calcium, cerium and scandium is further mixed in the range of 1:9 to 9:1 in a ratio of the silicon carbide to the slag forming metallic compound.

⑦ The gas generating agent composition ⑤, ⑥ wherein the slag forming metallic compound is at least one of oxide, hydroxide, nitride, carbide, carbonate and oxalate of the slag forming metal.

⑧ The gas generating agent composition ⑤, ⑥ wherein the slag forming metallic compound is synthetic hydrotalcite.

As mentioned above, the present invention provides a gas generating agent comprising nitrogenous organic compound as a fuel component and an oxidizing agent for burning it as its major components, to which either or both of metal nitride and metal carbide as the slag forming agent is added, so that the metal nitride and the metal carbide can be allowed to react with the metallic component or oxide thereof contained in the nitrogenous organic compound or the oxidizing agent, to form easily collectable slag. This can provide the results that the fuel component or the metal oxide derived from the oxidizing agent is allowed to react with the nitride or carbide in the process of combustion reaction, to form the high-viscosity slag to thereby produce the slag that can be easily collected by the filtering part and that the nitrogen gas produced by the burning of the metal nitride or the carbonic acid gas produced by the burning of metal carbide can contribute to the inflation of the air bag, together with the nitrogen gas, carbonic acid gas and steam produced by the burning of the nitrogenous organic compound of the fuel compound, and as such can contribute to reduction of the total volume of gas generating agents and reduction of size of the gas generator.

The slag forming metallic component that is allowed to react with the metal nitride or the metal carbide to form the high-viscosity slag in accordance with the type of the metal nitride or the metal carbide may be contained in the fuel component or the oxidizing agent or may alternatively be added in the form of an element (a simple substance) or any independent compound, so that the high-viscosity slag can surely be produced to provide improved slag collecting efficiency.

Particularly preferable gas generating agent compositions include a gas generating agent of system using 5-aminotetrazoles (5-ATZ) as the fuel component and strontium nitrate as the oxidizing agent and adding thereto silicon nitride or silicon carbide; and those based on this system and using hydrotalcites both as the binder and the slag forming metallic component or adding thereto the slag forming metallic component that is allowed to react with the metal nitride or the metal carbide to form the high-viscosity slag.

BRIEF DESCRIPTION OF THE DRAWINGS

FIG. 3 is a diagram showing the result of the 60 liter tank test.

BEST MODE FOR CARRYING OUT THE INVENTION

Figure 1:
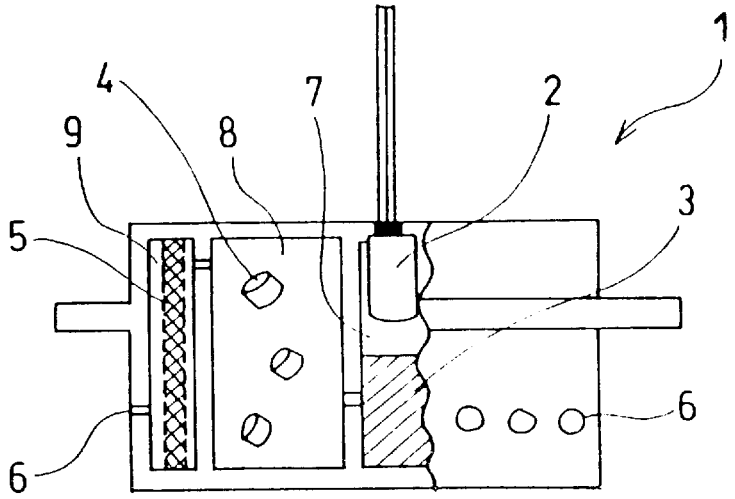
FIG. 1 is a schematic sectional view of a gas generator used in an embodiment of the present invention.

The detailed description on the present invention will be given below. The gas generating agent of the present invention basically comprises nitrogenous organic compound as a fuel component; an oxidizing agent for burning the nitrogenous organic compound; and metal nitride or metal carbide used as a slag forming agent for improving slag collecting efficiencies.

Now, the nitrogenous organic compound used in the present invention will be described first. In the gas generating agent of the present invention, the nitrogenous organic compound used as the fuel component is a non-azide compound and also an organic compound containing nitrogen as a major atom in the structural formula. Specifically, at least one nitrogenous organic compound selected from the group consisting of tetrazole, aminotetrazole, bitetrazole, azobitetrazole, nitrotetrazole, nitroaminotetrazole, triazole, nitroguanidine, aminoguanidine, triaminoguanidine nitrate, dicyanamido, dicyandiamido, carbohydrazide, hydrazocarbonamido, azodicarbonamide, oxamide and ammonium oxalate or their salts of alkaline metals, alkaline earth metals, transition metals or rare earth metals may be used. Of these nitrogenous organic compounds, cyclic nitrogen compounds including tetrazoles, triazols or salts thereof as listed above are preferable. Particularly preferable are tetrazoles having a high proportion of an atom of nitrogen in the molecular structure and having the structure of inherently restraining production of harmful CO gas and high handling safety, or specifically, 5-aminotetrazoles or metallic salts thereof as listed above. Preferably, the gas generating agent has the content of the fuel component of 20–50% (weight %, unless otherwise specified below). With the content of the fuel component of not more than 20%, a limited amount of gas is generated, so that an inflating failure of the air bag may possibly be caused. On the other hand, with the content of the fuel component in excess of 50%, the added amount of oxidizing agent is relatively reduced to cause incomplete combustion and, as a result of this, there is a possible fear that a large amount of harmful CO gas may be generated. Further, in the extreme, there is a possible fear that unburned material may be produced.

In using the fuel component, the particle size is preferably adjusted in advance by pulverizing the fuel component by addition of a small amount of consolidation preventing agent. In the present invention, it is particular preferable that the fuel component is pulverized to 5–80 $\mu$m in the 50% average particle diameter of a reference number. The consolidation preventing agents which may then be added include impalpable powder of metal nitride or metal carbide as discussed later or a usual consolidation preventing agent as combined therewith and finely powdered. It is noted that the 50% average particle diameter of a reference number is a method by which a particle size profile is expressed with respect to a reference number: when the total number of particles is set to be 100, the particle size obtained when the particles integrated from the smaller number reach 50 is called as the 50% average particle diameter of a reference number.

Referring now to the oxidizing agent used in the gas generating agent of the present invention, it comprises at least one oxidizing agent selected from the group consisting of nitrates of alkaline metal or alkaline earth metal, chlorates of alkaline metal or alkaline earth metal, perchlorates of alkaline metal or alkaline earth metal and ammonium nitrates. Particularly preferable is strontium nitrate containing a high-viscosity slag forming metallic component discussed later. In using the oxidizing agent, the particle size is preferably adjusted in advance by pulverizing the oxidizing agent by addition of a small amount of consolidation preventing agent, as in the case of the abovesaid fuel component. In the present invention, it is particular preferable that the oxidizing agent is pulverized to 5–80 $\mu$m in the 50% average particle diameter of the reference number. The consolidation preventing agents which may then be added include impalpable powder of metal nitride or metal carbide as discussed later or a usual consolidation preventing agent as combined therewith and finely powdered. Preferably, the content of the oxidizing agent is in the range of 30–70% of the total gas generating agent. With the content of the oxidizing agent of less than 30%, an insufficient amount of oxygen is supplied, so that incomplete combustion may be caused to produce harmful CO gas or, in the extreme, unburned material may be produced in the fuel, so that the required gas for inflating the air bag cannot be supplied to cause an inflating failure of the air bag. On the other hand, with the content of the oxidizing agent in excess of 70%, there is a fear that shortages of fuel may be caused conversely, so that the required gas for inflating the air bag cannot be supplied to cause an inflating failure of the air bag, as in the former case.

Referring now to the metal nitrides used in the gas generating agent of the present invention, it comprises at least one metal nitride selected from the group consisting of silicon nitride ($Si_3N_4$), boron nitride (BN), aluminum nitride (AlN), magnesium nitride ($Mg_3N_2$), molybdenum nitride ($MoN/Mo_2N$), tungsten nitride ($WN_2/W_2N,W_2N_3$), calcium nitride ($Ca_3N_2$), barium nitride ($Ba_3N_2$), strontium nitride ($Sr_3\ N_2$), zinc nitride ($Zn_3N_2$), sodium nitride ($Na_3N$), copper nitride ($Cu_3N$), titanium nitride (TiN), manganese nitride ($Mn_4N$), vanadium nitride (VN), nickel nitride ($Ni_3N/Ni_3N_2$), cobalt nitride ($Co_2N/CO_2N/Co_3N_2$), iron nitride ($Fe_2N/Fe_3N/Fe_4N$), zirconium nitride (ZrN), chromium nitride ($CrN/Cr_2N$),tantalum nitride (TaN), niobium nitride (NbN), cerium nitride (CeN), scandium nitride (ScN), yttrium nitride (YN) and germanium nitride ($Ge_3N_4$).

Of the metal nitrides listed above, the sodium nitride ($Na_3N$) and the sodium azide ($NaN_3$) which have been used hitherto as the fuel of the gas generating agent are compounds fundamentally different from each other, and the sodium nitride is not included in the concept of the metal nitride defined in the present invention.

Of the these metal nitrides, silicon nitride, boron nitride, aluminum nitride, molybdenum nitride, tungsten nitride, titanium nitride, vanadium nitride, zirconium nitride, chromium nitride, tantalum nitride and niobium nitride, which are called as fine ceramics and are used as heat-resistant materials which are thermally stable and high resistant, have the property of burning in high-temperature oxidizing atmospheres, as in the case of the other metal nitrides. In the present invention, both of the slag forming and the gas generation are simultaneously provided through the use of their burning property. For example, in the case of silicon nitride, nitrogen and silicate are produced by oxidization reaction with strontium nitrate as in the following formula (1):

$$2Si_3N_4+6Sr(NO_3)_2\rightarrow 3SrSiO_3+1ON_2+9O_2 \quad (1)$$

The nitrogen gas thus generated are released in the air bag, together with the nitrogen gas and carbon dioxide gas produced by the burning of the fuel components to be effectively used for inflating the air bag. The oxygen is used for the burning of the fuel components.

It is to be noted that the quantity of strontium nitrate used in the gas generating agent of the present invention is much more than the quantity consumed by the reaction in accordance with the abovesaid formula (1). Accordingly, it seems that although the above said reaction is partially established, the strontium silicate represented in the following formula (3) is produced on a surface of strontium oxide produced by the decomposition of strontium nitrate represented in the following formula (2):

$$2Sr(NO_3)_2\rightarrow 2SrO+2N_2+5O_2 \quad (2)$$

$$SrO+SrSiO_3\rightarrow Sr_xSiO_y \quad (3)$$

[where (x,y)=(2,4),(3,5); the coefficient of the reaction formula (3) is omitted.]

Also, while the strontium oxide produced by the decomposition of strontium nitrate, which is an oxide having a high melting point (2,430° C.), is produced in the form of a fine solid particle in the combustion process in the gas generator, various kinds of silicates having melting points of about 1,600° C. are formed on surfaces of the particles by the reaction of the abovesaid formula (3). The silicates thus produced are in the molten state of high viscosity under environmental reaction temperature, so the fine particles are fused together to aggregate, resulting in large particles to be easily collected in the filtering members in the gas generator.

In the case where the metal nitride is aluminum nitride (AlN), the formulas (1) and (3) are rewritten as follows. It is to be noted that the coefficient of the formula (5) is omitted.

$$2AlN+Sr(NO_3)_2\rightarrow Sr(AlO_2)_2+2N_2+O_2 \quad (4)$$

$$SrO+Sr(NO_3)_2\rightarrow Sr_x(AlO_2)_y \quad (5)$$

Alminates thus produced also form high-viscosity slag layers on surfaces of the solid particles (SrO) to allow the fine slag particles to fuse and aggregate, to thereby form the slag that can be easily filtered by the filters.

It is preferable that the added amount of the metal nitride is in the range of 0.5 to 20% of the total gas generating agent. With the metal nitride of not more than 0.5%, the slag collecting effects cannot be expected, while on the other hand, with the metal nitride in excess of 20%, the added amounts of fuel and oxidizing agent are limited, so that there presents a possible fear of shortage of gas generation and incomplete combustion. Preferably, their particle diameter is not more than 5 $\mu$m, particularly not more than 1 $\mu$m, in the 50% average particle diameter of reference number, because the finer the particle diameter, the more the effects can be produced. Further, when a small amount of fine particulate thereof is added to the fuel component or oxidizing agent component when pulverized, the small amount of fine particulate can act as a consolidation preventing agent for those pulverized components and also can be dispersed uniformly in the oxidizing agent and the fuel, to ensure uniform reaction for the slag. When the metal nitride is used as the consolidation preventing agent, a usual consolidation agent may be used in combination with it.

An example of the use of the metal nitride for the gas generating agent is disclosed by Japanese Patent Publication No. Hei 6(1994)-84274. The known gas generating agent uses aluminum nitride, boron nitride, silicon nitride or transition metal nitride as a substitute for the known metallic compound azide, using these metal nitrides as the so-called fuel components. Thus, the prior art is fundamentally different in concept from the present invention according to which the metal nitride is used as the slag forming agent, to provide improved slag collecting capabilities.

The metal carbides will now be described, which are used as the slag forming agent in the present invention, as in the case of the metal nitrides. The metal carbides used in the present invention include at least one metal carbide selected from the group consisting of silicon carbide (SiC), boron carbide ($B_4C$), aluminum carbide ($Al_4C_3$), magnesium carbide ($MgC_2/Mg_2C_3$), molybdenum carbide ($MoC/Mo_2C$), tungsten carbide ($WC/W_2C$), calcium carbide ($CaC_2$), barium carbide ($BaC_2$), strontium carbide ($SrC_2$), zinc carbide ($ZnC_2$), sodium carbide ($Na_2C_2$), copper carbide ($Cu_2C_2$), titanium carbide (TiC), manganese carbide ($Mn_3C$), vanadium carbide (VC), nickel carbide ($Ni_3C$), cobalt carbide ($Co_2C/CoC_2$), iron carbide ($Fe_2C/Fe_3C$), zirconium carbide (ZrC), chromium carbide ($Cr_3C_2/Cr_7C_3/Cr_{23}C_6$), tantalum carbide (TaC), niobium carbide (NbC), cerium carbide ($CeC_2$), scandium carbide ($ScC_2$), yttrium carbide ($YC_2$) and germanium carbide (GeC).

Of these metal carbides, silicon carbide, boron carbide, molybdenum carbide, tungsten carbide, titanium carbide, vanadium carbide, zirconium carbide, chromium carbide, tantalum carbide and niobium carbide, which are called as fine ceramics and are used as heat-resistant materials which are thermally stable and high resistant, have the property of burning in high-temperature oxidizing atmospheres, as in the case of the other metal carbides. In the present invention, both of the slag forming and the gas generation are simultaneously provided through the use of their burning property. For example, in the case of silicon carbide, carbon dioxide gas and silicate are produced by oxidization reaction as in the following formula (6):

$$2SiC+2Sr(NO_3)_2 \rightarrow 2SrSiO_3+2CO_2+2N_2+O_2 \quad (6)$$

The carbon dioxide gas and nitrogen thus generated are released in the air bag together with the nitrogen gas, carbon dioxide gas and water vapor produced by the burning of the fuel components, to be effectively used for the inflation of the air bag, and the oxygen is used for the burning of the fuel components.

On the other hand, the additionally produced silicate reacts with SrO which is produced as a combustion residue by decomposition of strontium nitrate through the reaction as represented in the above said reaction formulas (3), (5), to form high-viscosity slag that can be easily collected by the filtering part of the gas generator, as in the abovesaid case. When strontium nitrate is used as the oxidizing agent, the strontium oxide (SrO) produced as the combustion residue reacts with the carbon gas produced by the formula (6) in accordance with the reaction given by the following formula, to produce strontium carbonate.

$$SrO+CO_2 \rightarrow SrCO_3 \quad (7)$$

The strontium carbonate also comes to be a molten state of high-viscosity at around 1,500° C., as in the case of the strontium silicate. Accordingly, the strontium carbonate of high-viscosity is formed on surfaces of high-melting particles of the solid strontium oxide, then allowing the fine particles of the combustion residues to fuse together and aggregate, to form large particles to be easily collected by the filtering members in the gas generator.

It is preferable that the added amount of these metal carbides is in the range of 0.5 to 20% of the total gas generating agent. With the metal carbonate of not more than 0.5%, the adequate slag collecting effects cannot be expected, while on the other hand, with the metal carbonate in excess of 20%, the added amounts of fuel and oxidizing agent are limited, so that there presents a possible fear of shortage of gas generation and incomplete combustion. Preferably, their particle diameter is not more than 5 $\mu$m, more preferably, not more than 1 $\mu$m, in the 50% average particle diameter of reference number, because the finer the particle diameter, the more the effects can be produced. Particularly, when a small amount of fine particulate thereof is added to the fuel component or oxidizing agent component when pulverized, the fine particulate can act as a consolidation preventing agent for those pulverized components and also can be dispersed uniformly in the oxidizing agent and the fuel, to ensure uniform reaction for the slag.

While the metal carbide can of course be used in combination with the abovesaid metal nitride, the metal carbide is then preferably mixed to be 0.5–20% in total of the metal carbide and the metal nitride, when combined.

The basic composition of the gas generating agent of the present invention basically comprises the nitrogenous organic compound, the oxidizing agent and the metal nitride or the metal carbide (or both of them). To provide further improved slag collecting efficiencies, a slag forming metallic component which can react with the metallic component of the metal nitride or metal carbide or the oxide thereof to produce high-viscosity slag may be added in the form of a single substance or a compound. Specifically, the slag collecting and aggregating method is such that the metal nitride or the metal carbide is allowed to react with the oxide of alkaline metal or alkaline earth metal which is produced by the reaction with the fuel component and the oxidizing agent, to form the high-viscosity slag, and further the slag forming metallic component which can positively react with the metal nitride or metal carbide to form the high-viscosity slag is added, whereby the oxide of the alkaline metal or alkaline earth metal is collected and aggregated through the use of the viscosity.

The slag forming metallic components which may be used in the present invention include at least one slag forming component selected from the group consisting of silicon, boron, aluminum, alkaline metals, alkaline earth metals, transition metals and rare earth metals, which are added in the form of a single substance or a compound. The metallic components of the slag forming metallic components are properly selected with reference to the type of the metal nitride or metal carbide, to form the high-viscosity slag. For example, when Fe is used as the metallic component of the metal nitride or metal carbide and Na is selected as the slag forming metallic component, sodium ferrite having the melting point of 1,347° C. is produced by the following reaction.

$$Na_2O+2FeO \rightarrow 2NaFeO_2 \quad (8)$$

Likewise, when Al is used as the metallic component of the nitride or carbide and Na is selected as the slag forming metallic component, sodium aluminate having the melting point of 1,650° C. is produced by the following reaction.

$$Na_2O+Al_2O_3 \rightarrow 2NaAlO_2 \quad (9)$$

When silicon nitride (or silicon nitride) is used as nitride (or carbide), the slag forming metallic components preferably include at least one slag forming metallic component selected from the group consisting of aluminum (Al), magnesium (Mg), yttrium (Y), calcium (Ca), cerium (Ce) and scandium (Sc). The high-viscosity slag is easily formed by oxides of these metals and silicate originating from silicon nitride or silicon carbide. Preferably, the slag forming metallic component is added in the range of 1:9 to 9:1 in a ratio of the slag forming metallic component to the metal nitride or the metal carbide.

There are two methods for adding the slag forming metallic components: one is a method in which the slag forming metallic component is added in the form of metallic component of the oxidizing agent or metal salt of nitrogenous organic compound for combustion and the other is a method in which the slag forming metallic component is separately added in the form of any compound. Though either of them provides the same slag forming form, not only the slag forming effect but also some other combined effects should preferably be provided in terms of providing reduced number of raw materials to be added. The method of adding hydrotalcites (hereinafter it is simply referred to as "HTS") can be recited as a particularly preferable example. The HTS is a compound for which the general chemical formula is the same formula as described in Gypsum & Lime No. 187 (1983), pages 47–53 and as follows.

$$[M^{2+}_{1-x}M^{3+}_{x}(OH)_2]^{x+}[A^{n-}_{x/n}.mH_2O]^{x-}$$

where $M^{2+}$ represents a bivalent metal including $Mg^{2+}$, $Mn^{2+}$, $Fe^{2+}$, $Co^{2+}$, $Ni^{2+}$, $Cu^{2+}$ and $Zn^{2+}$;

$M^{3+}$ represents a trivalent metal including $Al^{3+}$, $Fe^{3+}$, $Cr^{3+}$, $Co^{3+}$ and $In^{3+}$;

$A^{n-}$ represents an n-valence anion including $OH^-$, $F^-$, $Cl^-$, $NO_3^-$, $CO_3^{2-}$, $SO_4^{2-}$, $Fe(CN)_6^{3-}$, $CH_3COO^-$, oxalate ion and salicylate ion; and $0<x\leqq 0.33$.

The HTS is a porous material having water of crystallization and is very useful as a binder for a gas generating agent of nitrogen base organic compound. The gas generating agent containing the HTS as the binder can provide a degree of hardness (25–30 Kg) much higher than a degree of hardness of 10–15 Kg (Monsant type hardness meter) of a pellet of a general type of azide base gas generating agent even in a low pelletization pressure, especially when the nitrogenous organic compound having the tetrazole as its major component is used for the fuel, as described in detail by Japanese Patent Application No. Hei 8(1996)-277066 which is the applicant's earlier application. This seems to be attributed to the HTS having the common property of being liable to absorb moisture to allow the components of the gas generating agents to be bound firmly. The pellet using this binder keeps its characteristic and flammability characteristic unchanged against the thermal shock caused by temperature being raised and fallen repeatedly, thus enabling the pellet to be minimized in deterioration with age after practical installation on a vehicle, to be very stable in properties.

Typical of the HTS is the synthetic hydrotalcite (hereinafter it is simply referred to as "synthetic HTS") for which the chemical formula is $Mg_6Al_2(OH)_{16}CO_3.4H_2O$ or the pyroaurite for which the chemical formula is $Mg_6Fe_2(OH)_{16}CO_3.4H_2O$ . The synthetic HTS is preferable in terms of availability and costs.

Further, for example, the synthetic HTS decomposes as shown in the following reaction formula, so that the HTS produces no harmful gas during the combustion of the gas generating agent. Also, the reaction itself is an endothermic reaction, and as such can provide an advantageous effect of reducing a heat release value of the gas generating agent when burned, to reduce the combustion temperature.

$$Mg_6Al_2(OH)_{16}CO_3.4H_2O \rightarrow 6MgO+Al_2O_3+CO_2+12H_2O \quad (10)$$

Further, the MgO and $Al_2O_3$ obtained by the decomposition reaction are the high-melting oxides of slag forming metallic components, and the silicate (e.g. $SrSiO_3$) of metallic components contained in the metal nitride or metal carbide and the MgO produced by the decomposition of the synthetic HTS are allowed to react with each other as shown in the following formula, to form an easily filterable, glassy, double salt of silicate of magnesium as the slag.

$$MgO+SrSiO_3 \rightarrow MgO.SrSiO_3 \quad (11)$$

Also, the decomposition product itself of the synthetic HTS is also allowed to form an easily filterable spinel by the slag reaction which is acid-base reaction shown in the following formula.

$$MgO+Al_2O_3 \rightarrow MgAl_2O_4 \quad (12)$$

The HTS is added in the range of 2 to 30% by weight in the total gas generating agent composition, when added as the binder. A less than 2% HTS has difficulties in serving as the binder, while on the other hand, a more than 30% HTS causes reduction of an added amount of other components to lead to difficulties in serving as the explosive composition. The particle diameter of the HTS is also an important factor for production technique. According to the present invention, the 50% average particle diameter of a reference number of the binder is preferably set to be not more than 30 μm. With a particle size of the binder larger than this, the effect of binding the abovesaid components may be reduced to make it difficult to expect the activity as the binder, thus there being a fear that a required strength of the formed member cannot be obtained.

The gas generating agent is generally used in the form of pellet or in the disk-like form. When the gas generating agent is formed into pellet or a disk-like form, a formability modifying agent may be added for the purpose of preventing generation of cracks or equivalent in the formed member. According to the present invention, a 0.01 to 0.5% addition of water-soluble polymer compound may be given as the formability modifying agent. Examples of the water-soluble polymer compounds which may be used include polyvinyl alcohol, polyethylene glycol, polypropylene glycol, polyvinyl ether, polymaleic copolymers, polyethylene imide, polyvinyl pyrrolidone, polyacrylamide, sodium polyacrylate and ammonium polyacrylate. At least one water soluble polymer is used as required.

For the purpose of providing improved fluidity of powder when the gas generating agents are formed into pellets, at least one lubricant selected from the group consisting of stearic acid, zinc stearate, magnesium stearate, calcium stearate, aluminum stearate, molybdenum disulfide, graphite, atomized silica and boron nitride may be added in the range of 0.1 to 1% of the total gas generating agent. This can provide further improved formability of the gas generating agent.

The gas generating agents thus formed may be heat-treated at 100 to 120° C. for about 2 to about 24 hours after formed, to thereby produce the formed products of the gas generating agents which are resistant to deterioration with age. The heat-treatment is very effective particularly for enduring harsh conditions such as a 107° C.×400 hrs. condition. The heat-treatment for less than 2 hours is insufficient and that for more than 24 hours will be of meaningless, for the reason of which the heat-treatment time should be selected from the range of 2 to 24 hours, preferably 5 to 20 hours. Also, the heat-treatment at less than 100° C. is not effective and that at more than 120° C. may cause deterioration rather than improvement, for the reason of which the heat-treatment temperature should be selected from the range of 100 to 120° C., preferably 105 to 115° C.

Next, description on the preferable combination of the components of the present invention will be given. First of all, preferable as fuel components are cyclic nitrogen compounds which are stable and safe materials, having high proportion of an atom of nitrogen in the molecular structure such that they are allowed to decompose to release a large amount of nitrogen gas and also having the effect of inherently restraining production of harmful carbon monoxide. Particularly preferable is 5-aminotetrazoles (5-ATZ). Preferable as the oxidizing agent is nitrate having the function of restraining production of NOx, and particularly preferable is strontium nitrate which produces an easily collectable, high-viscosity slag, in consideration of the combined use with the metal nitride or metal carbide. The content of the 5-ATZ is preferably in the range of 20 to 50% and that of the strontium nitrate is preferably in the range of 30 to 70%. With less than 20% 5-ATZ, an amount of gas generated is reduced, so that there is a possible fear of causing an inflating failure of the air bag. On the other hand, with more than 50% 5-ATZ, the content of the strontium nitrate of the oxidizing agent is reduced to cause incomplete combustion and thus produce a possible fear of generation of a large amount of harmful CO gas. Also, with the content of less than 30% strontium nitrate, insufficient oxidization power is provided to cause incomplete combustion of the 5-ATZ, thus presenting a possible fear of generation of a large amount of harmful CO gas. On the other hand, with more than 70% strontium nitride, an amount of gas generated is lacked due to lack of fuel, then arising a possible fear of causing an inflating failure of the air bag.

Silicon nitride is preferable as the metal nitride, and silicon carbide is preferable as the metal carbide. This is because silicon content is allowed to react with strontium oxide produced from strontium nitrate in the process of combustion or metallic components contained in the HTS added as the binder, to form easily collectable, high-viscosity silicate or double salt thereof. The added amount of silicon nitride or silicon carbide is preferably in the range of 0.5 to 20%. With a less than 0.5% silicon nitride or silicon carbide, a generation rate of the slag-reaction is reduced, so that MgO or $Al_2O_3$, which are high-melting oxides produced from the strontium oxides or the HTS, may be released in the gas released into the air bag without being fully collected, to cause the burning of the air bag. On the other hand, with a more than 20% silicon nitride or silicon carbide, the content of 5-ATZ of the fuel component and of strontium nitrate of the oxidizing agent may be reduced to cause possible incomplete combustion for lack of an amount of gas generated or for lack of oxidizing agent.

Next, most preferable as the binder for binding the particulate mixture for the forming is the synthetic HTS that can produce the high-melting oxides of MgO and $Al_2O_3$. They causes the slag reaction with silicon nitride or silicon carbide in the combustion process, to produce the double salt of the high-viscosity silicate that is easily collected by the filtering part of the gas generator. The added amount of the synthetic HTS is preferably in the range of 2 to 10%. With a less than 2% synthetic HTS, a low degree of effectiveness of the binder is provided, while with a more than 10% synthetic HTS, the content of fuel and oxidizing agent may be reduced to cause the abovesaid detrimental effects. Further, it is needless to say that since the synthetic HTS have the effect of forming the high-viscosity slag by reaction with the metal nitride or metal carbide, as aforementioned, the slag reaction should also be considered to select the optimum range according to the amount of metal nitride or metal carbide added.

EXAMPLES

Further detailed description of the present invention will be given with reference to Examples below. It is to be noted that % used in the examples all indicate weight %.

Example 1

33.5% 5-ATZ used as the fuel component, 63.0% strontium nitrate used as the oxidizing agent and 3.5% silicon nitride used as the slag forming agent were dryblended with a V-type stirring machine. Before the stirring, impalpable powders of the silicon nitride (0.2 $\mu$m in the 50% average particle diameter of the reference number) were added in advance to the 5-ATZ and the strontium nitrate by amounts that were nearly proportionally allotted corresponding to their weights. Then, the mixture was pulverized to about 10 $\mu$m in the 50% average particle diameter of the reference number. The mixed powders were wet-kneaded for granulation in a rotary mixer, spraying polyvinyl alcohol solution as a formability modifying agent, to be formed into granules having a particle diameter of not more than 1 mm. The amount of polyvinyl alcohol solution then sprayed was 0.05% of the total mixture. After the granules were heated and dried, 0.2% zinc stearate of the total mixture was further added thereto and stirred, and the resulting mixture was press-formed with a rotary type tablet making apparatus to obtain the gas generating pellets of 5 mm in diameter, 2 mm in thickness and 88 mg in weight. Then, the pellets thus obtained were heat-treated at 110° C. for 10 hours.

Figure 2:
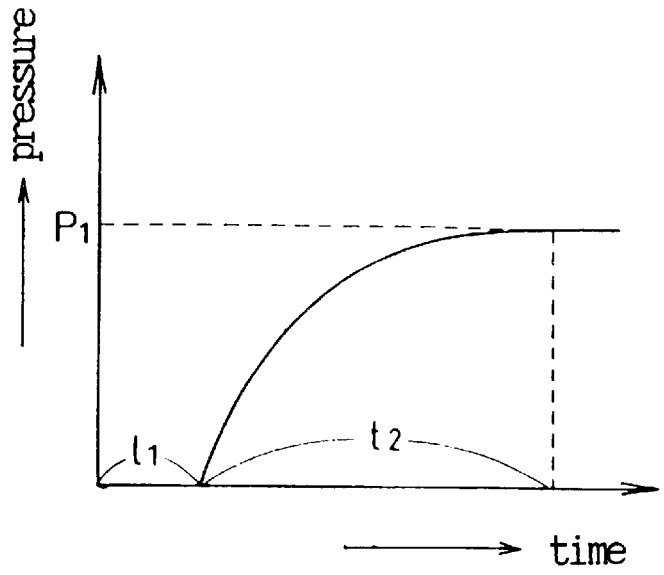
FIG. 2 is a graph showing the relation between the time (t) in a 60 liter tank test and the pressure (P) in a vessel.

46 g of the pellets thus obtained were loaded in a test-use gas generator 1 having the structure shown in FIG. 1. The test-use gas generator 1 comprises a central ignition chamber 7 placing therein an ignitor 2 and a transfer charge 3; a combustion chamber 8 provided around the ignition chamber and packing therein the gas generating agents 4; and a cooling/filtering chamber 9 provided outside of the combustion chamber and disposing therein a metallic filter 5. The combustion gas is exhausted outside from gas exhausting holes 6 in a housing, passing through the cooling/filtering chamber 9. A 60 liter tank test was carried out by use of the gas generator 1. In this test, the gas generator placed in a high pressure vessel having an internal volume of 60 liter is put in action to release the gas in the vessel, and changes of the internal pressure with time as shown in FIG. 2 and the amount of slag flown into the vessel are measured. The test results of the 60 liter tank test are shown as TABLE 1 in FIG. 3.

In TABLE 1, $P_1$ represents a maximum range pressure in the vessel (Kpa); $t_1$ represents the time before the start of operation of the gas generator from the power supply to the ignitor 2 (ms:millisecond); and $t_2$ represents a required time (ms) for the pressure to reach $P_1$ after the operation of the gas generator. The amount of slag flown out is expressed by weight (g) of solid residue exhausted from the gas exhausting holes 6 and collected in the vessel. Further, the quantity (ppm) of carbon monoxide (CO) and nitrogen oxides (NOx including NO and $NO_2$) cited as a typical gas that exerts an influence upon a human body was determined by an analysis of the gas accumulated in the vessel after the operation of the gas generator being conducted by use of a prescribed gas indicator tube.

Example 2

30.8% 5-ATZ, 65.7% strontium nitrate and 3.5% silicon carbide used as the metal carbide were dryblended with the V-type stirring machine. Before the stirring, impalpable powders of the silicon carbide (0.4 $\mu$m in the 50% average particle diameter of the reference number) were added in advance to the 5-ATZ and the strontium nitrate by amounts that were nearly proportionally allotted corresponding to their weights. Then, the powder thus mixed was pulverized to about 10 $\mu$m in the 50% average particle diameter of the reference number. The mixed powders were wet-kneaded for granulation in the rotary mixer, spraying polyvinyl alcohol solution as a formability modifying agent, to be formed into granules having a particle diameter of not more than 1 mm. The amount of polyvinyl alcohol solution then sprayed was 0.05% of the total mixture. After the granules were heated and dried, zinc stearate of 0.2% of the total mixture was further added thereto and stirred, and the resulting mixture was press-formed with the rotary type tablet making apparatus to obtain the gas generating pellets of 5 mm in diameter, 2 mm in thickness and 88 mg in weight. Then, the pellets thus obtained were heat-treated at 110° C. for 10 hours.

46 g of the pellets thus obtained were loaded in the gas generator of FIG. 1 as in Example 1, and the same test was conducted. The results obtained are shown as TABLE 1 in FIG. 3.

Example 3

As is the case of Example 1, the mixture comprising 32.0% 5-ATZ, 59.9% strontium nitrate, 3.6% silicon nitride and 4.5% synthetic HTS was prepared using 5-ATZ and strontium nitrate to which impalpable powders of the silicon nitride were added in advance and which were pulverized to about 10 μm in the 50% average particle diameter of the reference number. The mixture underwent the wet kneading granulation process in the same way as in Example 1, to produce the gas generating pellets of 5 mm in diameter, 2 mm in thickness and 88 mg in weight. Then, the pellets thus produced were heat-treated in the same manner. The silicon nitride and the synthetic HTS used here were 0.8 μm and 10 μm in the 50% average particle diameter of the reference number, respectively. 46 g of the pellets thus obtained were loaded in the gas generator of FIG. 1 as in Example 1 and the same test was conducted. The results obtained are shown as TABLE 1 in FIG. 3.

Example 4

As is the case of Example 2, the mixture comprising 30.0% 5-ATZ, 61.9% strontium nitrate, 3.6% silicon carbide and 4.5% synthetic HTS was prepared using 5-ATZ and strontium nitrate to which impalpable powders of the silicon carbide were added in advance and which were pulverized to about 10 μm in the 50% average particle diameter of the reference number. The mixture underwent the wet kneading granulation process in the same way as in Example 2, to produce the gas generating pellets of 5 mm in diameter, 2 mm in thickness and 88 mg in weight. Then, the pellets thus produced were heat-treated in the same manner. The silicon carbide and the synthetic HTS used here were 0.4 μm and 10 μm in the 50% average particle diameter of the reference number, respectively. 46 g of the pellets thus obtained were loaded in the gas generator of FIG. 1 as in Example 1 and the same test was conducted. The results obtained are shown as TABLE 1 in FIG. 3.

Example 5

As is the case of Example 1, the mixture comprising 31.0% 5-ATZ, 63.0% strontium nitrate, 3.4% silicon nitride and 2.6% aluminum nitride was prepared using 5-ATZ and strontium nitrate to which impalpable powders of the silicon nitride and aluminum nitride were added in advance and which were pulverized to about 10 μm in the 50% average particle diameter of the reference number. The mixture underwent the wet kneading granulation process in the same way as in Example 1, to produce the gas generating pellets of 5 mm in diameter, 2 mm in thickness and 88 mg in weight. Then, the pellets thus produced were heat-treated in the same manner. The silicon nitride and the aluminum nitride used here were 0.8 μm and 1.0 μm in the 50% average particle diameter of the reference number, respectively. 46 g of the pellets thus obtained were loaded in the gas generator of FIG. 1 as in Example 1 and the same test was conducted. The results obtained are shown as TABLE 1 in FIG. 3.

Example 6

As is the case of Example 1, the mixture comprising 31.0% 5-ATZ, 63.0% strontium nitrate, 3.4% silicon carbide and 2.6% of aluminum nitride was prepared using 5-ATZ and strontium nitrate to which impalpable powders of the silicon carbide and impalpable powders of the aluminum nitride were added in advance and which were pulverized to about 10 μm in the 50% average particle diameter of the reference number. The mixture underwent the same process as in Example 1, to produce the gas generating pellets of 5 mm in diameter, 2 mm in thickness and 88 mg in weight. Then, the pellets thus produced were heat-treated in the same manner. The silicon carbide and the aluminum nitride used here were 0.8 μm and 1.0 μm in the 50% average particle diameter of the reference number, respectively. 46 g of the pellets thus obtained were loaded in the gas generator of FIG. 1 as in Example 1 and the same test was conducted. The results obtained are shown as TABLE 1 in FIG. 3.

Example 7

As is the case of Example 1, the mixture comprising 32.3% 5-ATZ, 61.0% strontium nitrate, 3.5% silicon nitride and 3.2% aluminum oxide was prepared using 5-ATZ and strontium nitrate to which impalpable powders of the silicon nitride were added in advance and which were pulverized to about 10 μm in the 50% average particle diameter of the reference number. The mixture was formed into the gas generating pellets of 5 mm in diameter, 2 mm in thickness and 88 mg in weight in the samemanner as in Example 1 . Then, the pellets thus produced were heat-treated in the same manner. The silicon nitride used here was 0.8 μm in the 50% average particle diameter of the reference number. 46 g of the pellets thus obtained were loaded in the gas generator of FIG. 1 as in Example 1 and the same test was conducted. The results obtained are shown as TABLE 1 in FIG. 3.

Example 8

As is the case of Example 1, the mixture comprising 32.3% 5-ATZ, 61.0% strontium nitrate, 3.5% silicon carbide and 3.2% aluminum oxide was prepared using 5-ATZ and strontium nitrate to which impalpable powders of the silicon carbide were added in advance and which were pulverized to about 10 μm in the 50% average particle diameter of the reference number. The mixture was formed into the gas generating pellets of 5 mm in diameter, 2 mm in thickness and 88 mg in weight in the same manner as in Example 1 . Then, the pellets thus produced were heat-treated in the same manner. The silicon carbide used here was 0.8 μm in the 50% average particle diameter of the reference number. 46 g of the pellets thus obtained were loaded in the gas generator of FIG. 1 as in Example 1 and the same test was conducted. The results obtained are shown as TABLE 1 in FIG. 3.

Comparative Example 1

As is the case of Example 1, the mixture comprising 35.8% 5-ATZ, 62.2% strontium nitrate and 2.0% silicon dioxide was prepared using 5-ATZ and strontium nitrate to which impalpable powders of the silicon dioxide were added in advance and which were pulverized to about 10 μm in the 50% average particle diameter of the reference number. The mixture was formed into the gas generating pellets of 5 mm in diameter, 2 mm in thickness and 88 mg in weight in the same manner as in Example 1 . Then, the pellets thus produced were heat-treated in the same manner. The silicon dioxide used here was 0.014 μm in the 50% average particle diameter of the reference number. 46 g of the pellets thus obtained were loaded in the gas generator of FIG. 1 as in Example 1 and the same test was conducted. The results obtained are shown as TABLE 1 in FIG. 3.

Comparative Example 2

As is the case of Example 1, the mixture comprising 34.1% 5-ATZ, 59.3% strontium nitrate, 1.8% silicon dioxide and 4.8% synthetic HTS was prepared using 5-ATZ and strontium nitrate to which impalpable powders of the silicon dioxide were added in advance and which were pulverized to about 10 μm in the 50% average particle diameter of the reference number. The mixture was formed into the gas generating pellets of 5 mm in diameter, 2 mm in thickness and 88 mg in weight in the same manner as in Example 1 . Then, the pellets thus produced were heat-treated in the same manner. The silicon dioxide used here was 0.014 μm in the 50% average particle diameter of the reference number. 46 g of the pellets thus obtained were loaded in the gas generator of FIG. 1 as in Example 1 and the same test was conducted. The results obtained are shown as TABLE 1 in FIG. 3.

Comparative Example 3

As is the case of Example 1, the mixture comprising 33.2% 5-ATZ, 57.8% strontium nitrate, 4.5% silicon dioxide and 4.5% synthetic HTS was prepared using 5-ATZ and strontium nitrate to which impalpable powders of the silicon dioxide were added in advance and which were pulverized to about 10 μm in the 50% average particle diameter of the reference number. The mixture was formed into the gas generating pellets of 5 mm in diameter, 2 mm in thickness and 88 mg in weight in the same manner as in Example 1 . Then, the pellets thus produced were heat-treated in the same manner. The silicon dioxide used here was 0.014 μm in the 50% average particle diameter of the reference number. 46 g of the pellets thus obtained were loaded in the gas generator of FIG. 1 as in Example 1 and the same test was conducted. The results obtained are shown as TABLE 1 in FIG. 3.

As seen from TABLE 1 , the quantities of slag flown out are in the range of 4.0 to 4.5 g in all Examples 1 to 8, while on the other hand, large quantities of slag in excess of 11 g are flown out in Comparative Examples 1 and 2 in which about 2% silicon dioxide was added. It can be understood from this that the metallic components of the metal nitride or metal carbide in the gas generating agent of the present invention can form the high-viscosity slag to collect the slag in an effective manner.

In Comparative Example 3 in which an added amount of silicon dioxide is increased, the amount of slag flown out was slightly improved to be not more than 10 g, while the time $t_2$ required for the pressure to reach $P_1$, or the burning rate, was reduced and, resultantly, the value of $P_1$ was also lowered. In view of this, the amount of slag flown out and the burning rate are in an antinomy relation, so that it was difficult to perform optimizations of the both. On the other hand, though the gas generating agents of the present invention using the metal nitride or metal carbide shows similarity in slag forming reaction to the known one adding thereto the silicon dioxide, the metal nitride or metal carbide entails the generation of gas in the combustion process and generates the heat of reaction resulting from oxidation reaction, and as such probably promotes improvement of the burning rate and the maximum range pressure.

Further, the present invention shows the amounts of generated harmful CO gas of about 2,000 to 3,500 ppm, whereas Comparative Examples show 8,000 ppm higher than twice as much as in the present invention. It seems that this is because since the reaction in which the metal nitride or metal carbide used in the present invention reacts with oxygen to produce metallic oxides and nitrogen gas or carbonic acid gas is an exothermic reaction, the combustion temperature in the gas generator is increased so that the generation of CO can be restrained. From the fact that the maximum range pressure $P_1$ of the present invention shows a relatively high value, as compared with Comparative Examples, it is presumed that the reaction temperature is increased. In this connection, as the reaction temperature increases, the amounts of generated NOx increase in general, but contrarily the present invention shows relatively low values. In the present invention, it is presumed that the metallic components supplied as the metal nitride or metal carbide consume oxygen, so that the oxygen to react with the nitrogen gas is reduced.

As obvious from the explanation above, it will be understood that the metal nitrides or metal carbides used in the gas generating agents of the present invention provide outstanding differences in operation and effect, as compared with the generally used silicon dioxides.

As mentioned above, according to the present invention, the following outstanding effects can be achieved.

The metal nitride or metal carbide used as the slag forming agent is added to non-azide gas generating agent including nitrogenous organic component and the oxidizing agent as its major components, so that the metallic component of the metal nitride or metal carbide is allowed to react with harmful metallic oxide which is produced mainly from the oxidizing agent, to produce the high-viscosity slag. This enables the slag to be easily collected by the filters placed in the gas generator to suppress the outflow of the slag, thus providing improved safety in inflating the air bag.

Also, the compound containing the slag forming metallic component that is allowed to react with the metallic component of metal nitride or metal carbide or oxide thereof to produce the high-viscosity slag is added separately, so that even when atomized high-melting metallic oxides are generated, high-viscosity slag layers are formed on their surface layers by the slag reaction on the surfaces and are allowed to fuse and aggregate together to result in the combustion residues that can be easily filtered by the filters. Thus, the outflow of the harmful metallic oxides can be suppressed.

Also, the metal nitride or metal carbide decomposes to produce nitrogen gas or carbonic acid gas, and the gas components are useful for and contribute to the inflation of the air bag. Thus, the content of the nitrogenous organic compound as the fuel component can be saved, and as such can provide the contribution to the reduction of size and weight of the gas generator.

Also, since the reaction in which the metal nitride or metal carbide is burned in the presence of oxygen is an exothermic reaction, the combustion temperature in the gas generator is increased so that the generation of CO gas can be restrained and also higher pressure gas can be released into the air bag. Thus, the inflation of the air bag can further be ensured.

CAPABILITIES OF EXPLOITATION IN INDUSTRY

As mentioned above, the gas generating agent of the present invention provides reduced generation of harmful gas and besides increased capability of collecting the slag, and thus is very useful for use in the gas generator of an automobile air bag system.

What is claimed is:

1. A gas generating agent for an air bag comprising a fuel component, which is a nitrogenous organic compound, and an oxidizing agent as the major components of the gas generating agent, and at least 2.6% of silicon nitride functioning as consolidation preventing agent for at least either of said fuel component or said oxidizing agent, a metallic component being in said fuel component compound or in said oxidizing agent and said metal nitride further being able to react in a combustion process to form high-viscosity slag with said metallic component, further, containing an additional slag forming metallic component that can react with a metallic component of said metal nitride or oxide originating from the metal nitride in a combustion process to form said high-viscosity slag, the slag forming metallic component being an element or a compound.

2. A gas generating agent for an air bag as set forth in claim 1, wherein said silicon nitride as the consolidation preventing agent for at least either of said fuel component and said oxidizing agent is in the form of impalpable powder.

3. A gas generating agent for an air bag as set forth in claim 1, wherein said silicon nitride is added in the range of 2.6% to 20 weight % of the total gas generating agent.

4. A gas generating agent for an air bag as set forth in claim 1 or 3, wherein said slag forming metallic component is at least one slag forming metallic component selected from the group consisting of silicon, boron, aluminum, alkaline metals, alkaline earth metals, transition metals and rare earth metals.

5. A gas generating agent for an air bag as set forth in claim 1, wherein said additional slag forming metallic component is added thereto in the form of a hydrotalcite for which the general chemical formula is:

$$(M^{2+}_{1-x}M^{3+}_{x}(OH)_2)^{x+}(A^{n-}_{x/n}.mH_2O)^{x-}$$

where $M^{2+}$ represents bivalent metal including $Mg^{2+}$, $Mn^{2+}$, $Fe^{2+}$, $CO^{2+}$, $Ni^{2+}$, $Cu^{2+}$ and $Zn^{2+}$;

$M^{3+}$ represents bivalent metal including $Al^{3+}$, $Fe^{3+}$, $Cr^{3+}$, $CO^{3+}$ and $In^{3+}$;

$A^{n-}$ represents an n-valence anion including $OH^-$, $F^-$, $Cl^-$, $NO_3^-$, $CO_3^{2-}$, $SO_4^{2-}$, $Fe(CN)_6^{3-}$, $CH_3COO^-$, oxalate ion and salicylate ion; and $0<x\leqq 0.33$.

6. A gas generating agent for an air bag as set forth in claim 5, wherein said hydrotalcites is synthetic hydrotalcite for which the chemical formula is $Mg_6Al_2(OH)_{16}CO_3.4H_2O$, or pyroaurite for which the chemical formula is $Mg_6Fe_2(OH)_{16}CO_3.4H_2O$.

7. A gas generating agent for an air bag as set forth in claim 6, wherein said synthetic hydrotalcite or said pyroaurite is added in the form of a compound including a component both as a binder for said gas generating agent composition and as said slag forming metallic component.

8. A gas generating agent for an air bag as set forth in claim 5, wherein said synthetic hydrotalcite or said pyroaurite is added in amount of 2 to 10 weight % of the total gas generating agent.

9. A gas generating agent for an air bag as set forth in claim 1 or 3, wherein said nitrogenous organic compound is at least one nitrogenous organic compound selected from the group consisting of tetrazole, aminotetrazole, bitetrazole, azobitetrazole, nitrotetrazole, nitroaminotetrazole, triazole, nitroguanidine, aminoguanidine, triaminoguanidine nitrate, dicyanamido, dicyandiamido, carbohydrazide, hydrazocarbonamido, azodicarbonamide, oxamide and ammonium oxalate or their salts of alkaline metals, alkaline earth metals or transition metals.

10. A gas generating agent for an air bag as set forth in claim 1 or 3, wherein said nitrogenous organic compound is a cyclic nitrogen compound.

11. A gas generating agent for an air bag as set forth in claim 10, wherein said cyclic nitrogen compound is at least one cyclic nitrogen compound selected from the group consisting of tetrazole, aminotetrazole, bitetrazole, azobitetrazole, nitrotetrazole, nitroaminotetrazole, triazole or their salts of alkaline metals, alkaline earth metals or transition metals.

12. A gas generating agent for an air bag as set forth in claim 1 or 3, wherein said oxidizing agent is at least one oxidizing agent selected from the group consisting of nitrates of alkaline metal or alkaline earth metals, chlorates of alkaline metals or alkaline earth metals, perchlorates of alkaline metals or alkaline earth metals and ammonium nitrates.

13. A gas generating agent for an air bag as set forth in claim 1 or 3, wherein a water-soluble polymer compound is added as a formability modifying agent in amount of 0.01 to 0.5 weight % of the total gas generating agent composition to said gas generating agent composition.

14. A gas generating agent for an air bag as set forth in claim 13, wherein said water-soluble polymer compound is at least one water-soluble polymer compound selected from the group consisting of polyvinyl alcohol, polypropylene glycol, polyvinyl ether, polymaleic copolymers, polyethylene imide, polyvinyl pyrrolidone, polyacrylamide, sodium polyacrylate and ammonium polyacrylate.

15. A gas generating agent for an air bag as set forth in claim 1 or 3, wherein 0.01 to 1 weight % lubricant is added to said gas generating agent composition and is molded in a predetermined form.

16. A gas generating agent for an air bag as set forth in claim 15, wherein said lubricant is at least one lubricant selected from the group consisting of stearic acid, zinc stearate, magnesium stearate, calcium stearate, aluminum stearate, molybdenum disulfide and graphite.

17. A gas generating agent for an air bag comprising 20 to 50 weight % 5-aminotetrazole as a fuel component; 30 to 70 weight % strontium nitrate as an oxidizing agent; and 0.5 to 20 weight % silicon nitride as a slag forming agent; and 2 to 10 weight % synthetic hydrotalcite both as a binder and as a high-viscosity slag forming metallic compound.

18. A gas generating agent for an air bag comprising 20 to 50 weight % 5-aminotetrazole as a fuel component; 30 to 70 weight % strontium nitrate as an oxidizing agent; and 0.5 to 20 weight % silicon nitride as a slag forming agent, wherein a slag forming metallic compound comprising at least one slag forming metal selected from the group consisting of aluminum, magnesium, yttrium, calcium, cerium and scandium is further mixed in the range of 1:9 to 9:1 in a ratio of said silicon nitride to said slag forming metallic compound.

19. A gas generating agent for an air bag as set forth in claim 18, wherein said slag forming metallic compound is at least one of oxide, hydroxide, nitride, carbide, carbonate and oxalate of said slag forming metal.

20. A gas generating agent for an air bag as set forth in claim 18, wherein said slag forming metallic compound is synthetic hydrotalcite.

21. A gas generating agent for an air bag as set forth in claim 5, comprising 32% 5-amino triazole, 59.9% strontium nitrate, 3.6% silicon nitride and 4.5% synthetic hydrotalcite.

22. A gas generating agent for an air bag as set forth in claim 19, wherein said slag forming metallic compound is aluminum nitride or aluminum oxide.

* * * * *